United States Patent [19]

Hutchison

[11] 4,070,084

[45] Jan. 24, 1978

[54] CONTROLLED IMPEDANCE CONNECTOR

[75] Inventor: Robert V. Hutchison, Oceanside, Calif.

[73] Assignee: Burroughs Corporation, Detroit, Mich.

[21] Appl. No.: 688,185

[22] Filed: May 20, 1976

[51] Int. Cl.[2] ..... H01R 3/06; H05R 1/08

[52] U.S. Cl. ..... 339/143 R; 339/176 M

[58] Field of Search ..... 339/14 R, 14 P, 143 R, 339/176 M, 17 L, 278 A

[56] References Cited

U.S. PATENT DOCUMENTS

| | | | |
|---|---|---|---|
| 3,509,513 | 4/1970 | Russin | 339/143 R X |
| 3,634,806 | 1/1972 | Fergusson | 339/14 R |

*Primary Examiner*—Roy Lake

*Assistant Examiner*—E. F. Desmond

*Attorney, Agent, or Firm*—Robert J. Gaybrick; Manuel Quiogue; Kevin R. Peterson

[57] ABSTRACT

A controlled impedance connector for providing a high density controlled impedance interface between a computer backplane and printed circuit (PC) logic card circuitry having signal carrying conductors and a ground surface imbedded in a dielectric medium at selected spacings to achieve a desired characteristic impedance. A common ground surface is provided for a plurality of signal conductors which are in a selected geometrical relationship with the ground surface. Another embodiment of the invention uses a plurality of microstrips embedded in a dielectric medium and dielectrically separated from a common ground surface to achieve the desired characteristic impedance.

13 Claims, 7 Drawing Figures

CONTROLLED IMPEDANCE CONNECTOR

BACKGROUND OF THE INVENTION

The present invention generally relates to plug-in connectors for use with electronic signal processing apparatus. Specifically, the invention is a novel multiple conductor connector for interfacing circuit boards or logic circuit cards to computer backplanes and the like.

In present day digital signal processing apparatus, such as computers, the trend is toward faster switching speeds and multiple signal handling capabilities. That is, presently desired characteristics include higher signal frequencies and greater signal density. However, at switching frequencies over 100 megahertz, the dimensions of conventional printed circuit connectors are significant relative to the wavelengths at such high frequencies. Therefore, the characteristic impedances of the PC connectors become very critical because an impedance mismatch will cause undesired distortion and attenuation of the propagating signals.

Moreover, because present day signal processing equipment is capable of handling many signals, the number of interconnections in the backplane of a computer is quite large. The large number of interconnections along with today's compact circuitry make the capability of handling a greater number of signals with fewer connections a desirable feature. However, conventional PC connectors do not provide such a feature because these prior art devices require two connections for each signal: a signal carrying connection and a reference connection.

SUMMARY OF THE INVENTION

It is therefore a primary object of the present invention to provide a PC board connector having a controlled impedance.

It is a further object of the present invention to provide an improved PC board connector having a precisely obtainable impedance.

Still another object of the PC board connector of the present invention is to provide the capability of handling a large number of signals.

A further object of the invention is to increase the number of signals which can be transmitted by a PC board connector.

These and other objects are achieved by the present invention by providing novel features which overcome the disadvantages of the prior art devices. The present invention utilizes the principle of selectively spacing a signal carrying conductor from a ground reference surface common to all signal carrying conductors in a connector for achieving a desired characteristic impedance. That is, the geometrical relationship between the conductors as well as the dielectric constant of the dielectric medium between conductors is used to obtain a desired impedance. A particular embodiment of the present invention includes a reference ground plane and signal carrying pin-type conductors disposed at a uniform distance from the ground plane to obtain a desired impedance. Another embodiment of the subject invention uses a flexible microstrip having individual signal carrying conductors on one side of a flexible substrate and a common ground surface on the other side of the substrate. In both embodiments, all conductors are individual signal carriers and the common ground surface disposes of the need for a second conductor for each transmitted signal.

BRIEF DESCRIPTION OF THE DRAWING

The foregoing and other advantages which may be attained from the use of the present invention will become apparent from the following detailed description when read in conjunction with the drawing wherein.

DETAILED DESCRIPTION OF THE PREFERRED EMBODIMENT

Figure 1:
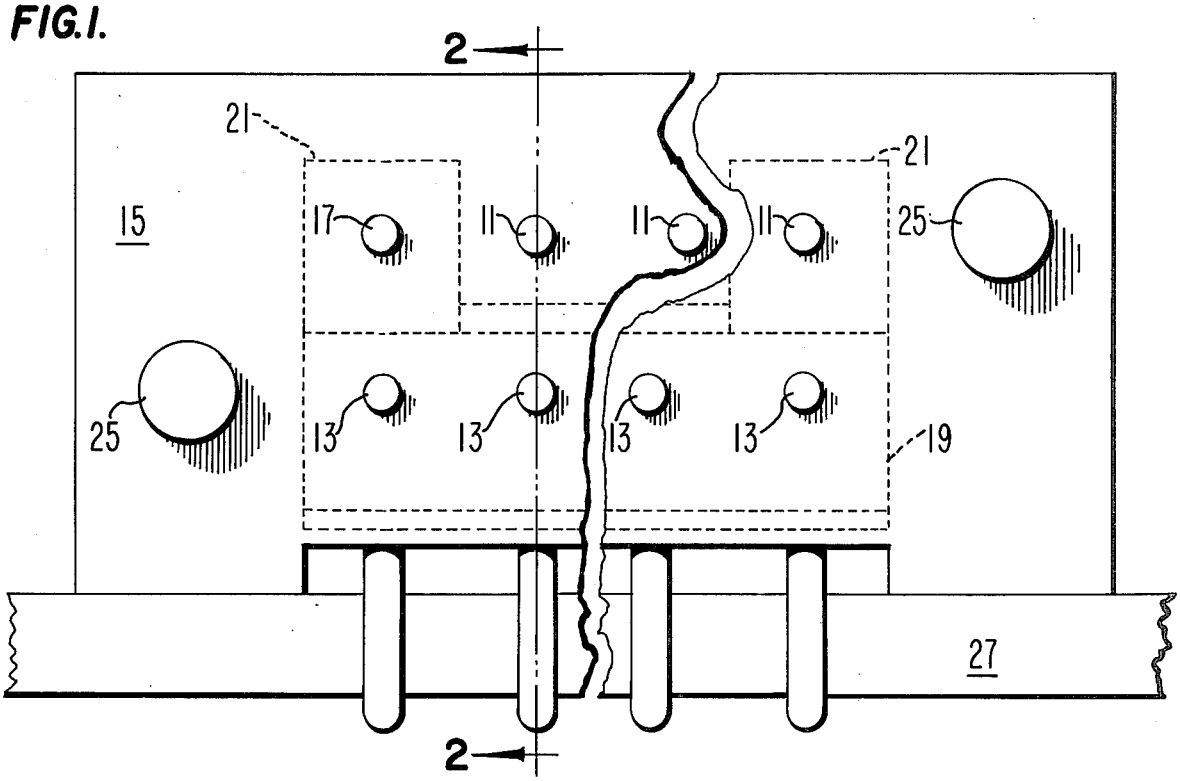
FIG. 1 is a plan view of the pin connector embodiment of the present invention using pins as the conductive elements.
Figure 2:
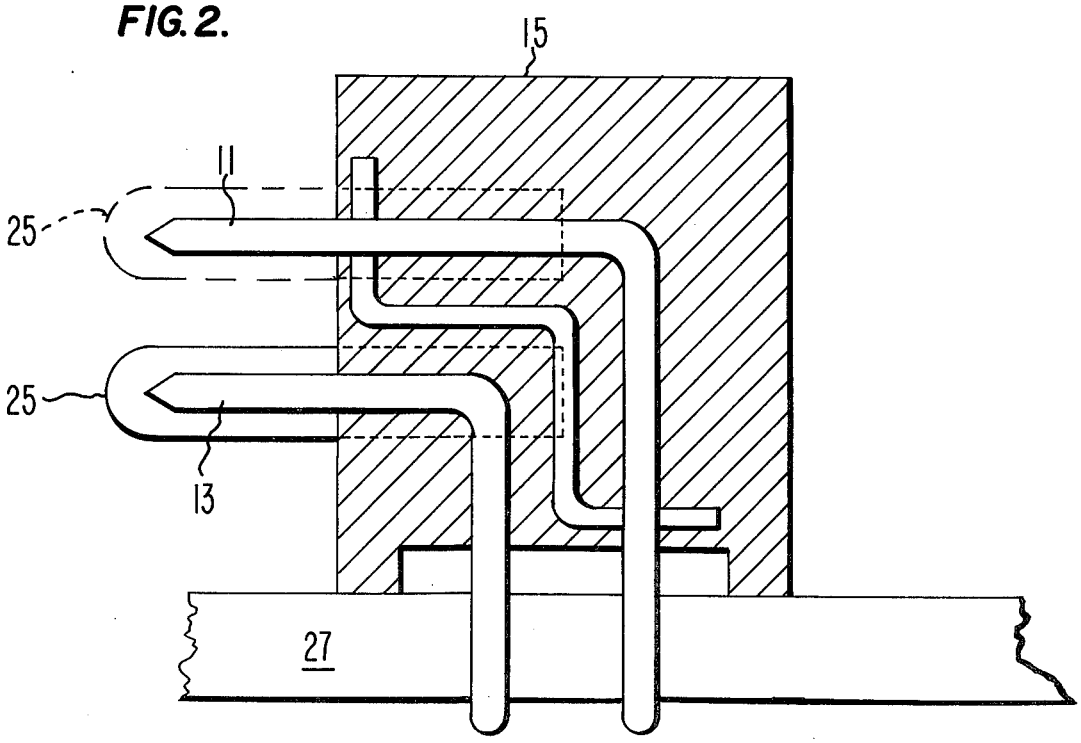
FIG. 2 is a sectional view of the pin connector embodiment of the present invention showing the relative positioning of the conductive pins and the ground surface.
Figure 3:
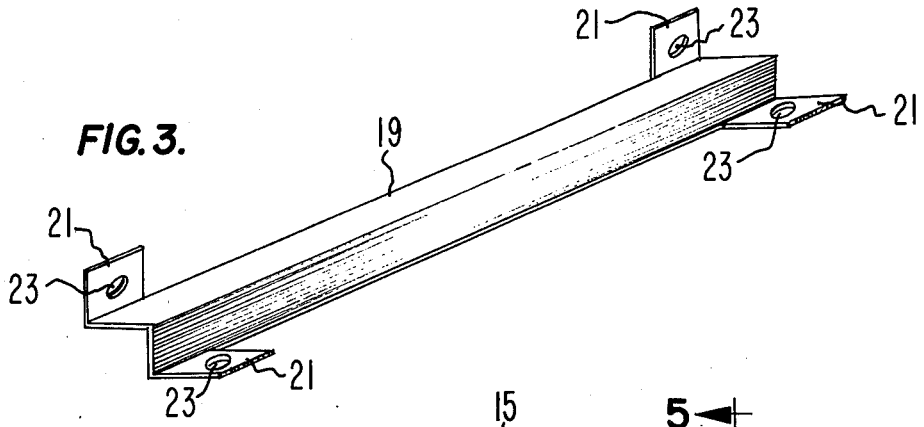
FIG. 3 is a perspective view of a metallic foil strip which is used in the embodiment of the present invention as shown in FIGS 1 and 2.
Figure 4:
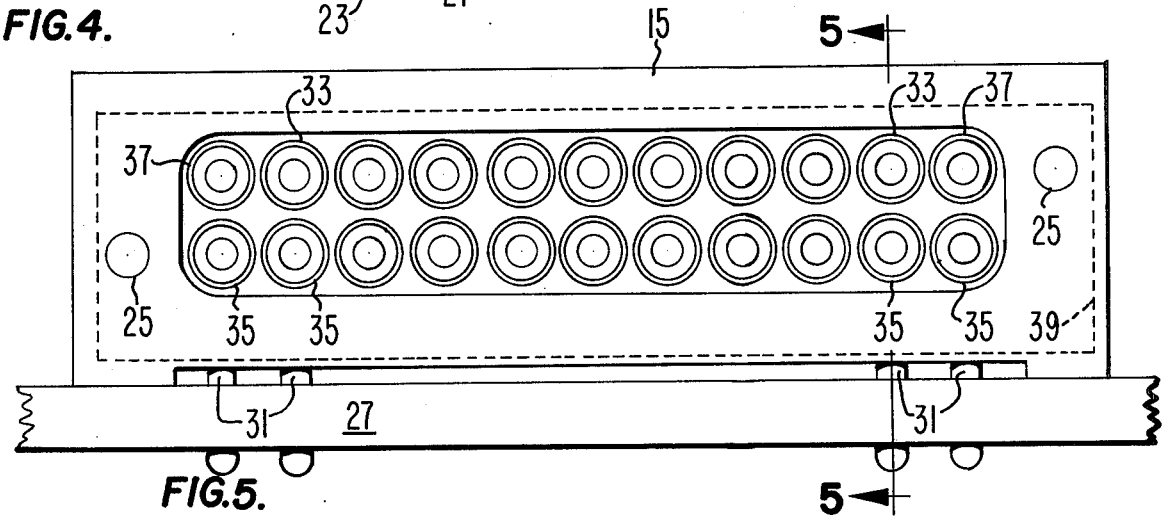
FIG. 4 is a plan view of a microstrip connector embodiment of the present invention.
Figure 5:
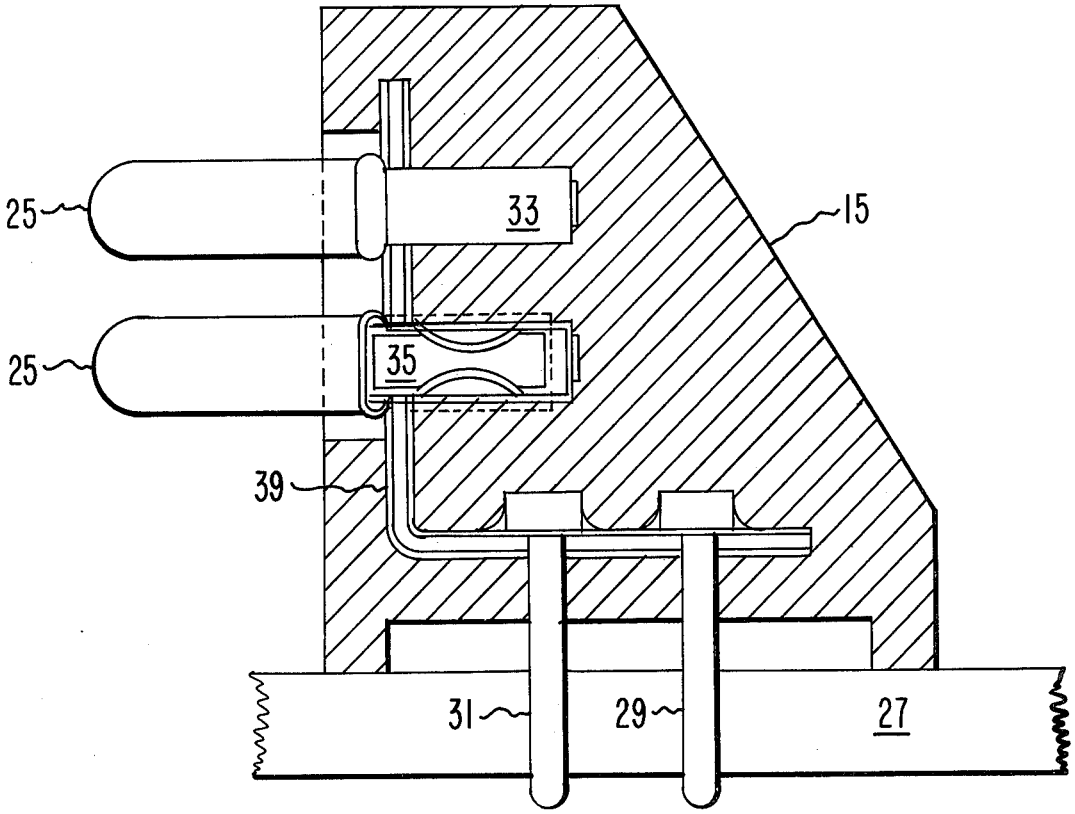
FIG. 5 is a sectional view of the microstrip connector embodiment of the present invention showing the relative positions of the conductive strips and the ground surface.

One embodiment of the present invention includes a first row of signal carrying right angle pins 11 and a second row of signal carrying right angle pins 13 which are embedded in a rigid dielectric block 15. At each end of the first row of signal carrying pins 11 is a reference ground pin 17 which is also embedded in the dielectric block 15 in a manner similar to the first signal carrying pins 11. Further embedded within the dielectric block 15 is a metallic foil strip 19 which is located between the rows of right angle pins 11 and 13 and continues along the longitudinal extent of the rows of pins. At each end of the foil strip 19, which is shown in greater detail in FIG. 3, conducting tabs 21 extend at right angles from the respective ends of the foil strip for interconnection with the ground pins 17. Holes 23 are provided in each of the conducting tabs 21 for insertion and conductive connection of the ground pins 17 to the foil strip 19. The foil strip 19 is substantially equidistantly spaced between the rows of right angle pins 11 and 13 along the foil strip. The spacing along the curved sections of the three conductors is slightly larger then the spacing along the linear regions, but does not affect the characteristic impedance achieved by the linear spacing as will be seen below. Finally, suitable locating pins 25 which can be made of plastic or some other rigid insulator are embedded within the dielectric block 15 for the ultimate purpose of aiding the placement and location of the connector of the present invention in a mating connector. The particular embodiment presently being discussed shows one of the locating pins 25 as having its center in line with the centers of the first row of right angle pin 11. The other locating pin 25 is located on the opposite end of the connector and has its center in line with centers of the second row of right angle pin 13. The blunt ends of the right angle pins 11 and 13 and the ground pins 17 may be suitably placed in a printed circuit board 27 as shown in FIGS. 1 and 2.

The above described structure allows a design determination of a characteristic impedance for impedance matching between the connector and the system with which it is used. This particular embodiment is essentially a "wire-over-ground" transmission line system and the characteristic impedance of such a system is given by the following equation:

$$Z_o = \sqrt{\frac{60}{\epsilon_r}} \ln \frac{(4h)}{(d)} \quad (1)$$

Where:

$\epsilon_r$ is the relative dielectric constant of the ambient medium;

$d$ is the diameter of the signal transmitting wire;

$h$ is the distance between the center of the wire and surface of the ground plane.

A specific example using readily available materials will now be used to illustrate the use of the "wire-over-ground" characteristics. Commercially available right angle pins 11, 13 of 0.025 inch diameter are to be embedded in an epoxy casting resin forming the dielectric block 15 and are to be separated by a metallic foil ground plane 19 of unknown thickness. The distance between the center points of the ends of each pair of corresponding right angle pins 11 and 13 is 0.100 inches. The distance $h$ between the center of the wire and the ground plane for a 50 ohm system is to be determined. Using Eq. (1) and inserting the fixed variables into the equation, the following equations are used to arrive at a determination of the distance $h$:

$$50 = \frac{60}{\sqrt{3.6}} \ln \frac{4h}{.025} \quad (2)$$

$$\ln \frac{4h}{.025} = 1.58 \quad (3)$$

$$\frac{4h}{.025} = e\ 1.58 \quad (4)$$

$$h = .030 \quad (5)$$

Since the distance between the wire centers is 0.100 inches and the distance $h$ is between the metallic foil ground plane 19 and only one wire, it is apparent that the thickness of the foil for the above given parameters should be 0.04 inches. From Eq. (1) in the above illustration it is readily seen that charateristic impedances approaching 100 ohms in pin connectors having 0.100 centers (as in the above illustration) may be achieved by using common low dielectric constant materials with thin metallic foil strips for the metallic ground plane 19. Moreover, additional design freedom can be obtained by slightly varying the diameter of the right angle pins 11 and 13. A further means of obtaining lower dielectric constants would be to use a rigid connector housing filled with air or foamed material as the dielectric medium instead of the solid dielectric block 15 previously described.

FIGS. 4 through 7 illustrate another embodiment based on the transmission line concept descriped above. Specifically, this approach uses an embedded microstrip which comprises conductive elements deposited on both sides of a flexible substrate which is fixedly embedded in a dielectric block. The characteristic impedance of this embodiment will be described further below. The embodiment shown in FIGS. 5 and 6 of the connector of the present invention is of the socket type for accepting mating plug connectors. As in the pin connector embodiment described above, this microstrip embodiment includes two rows of blunt ended pins 29 and 31 which are conductively mounted in the printed circuit board 27. Spring socket connectors are used for external coupling and are arranged in two rows of sockets 33 and 35. Ground connecting sockets 37 are provided at each end of the top row of spring socket connectors 33. A thin flexible microstrip 39 is embedded in the dielectric block 15 and has signal carrying conductors and a common ground plane coated thereon. Each signal carrying socket 33 is connected by an appropriate conductor on the microstrip 39 to a corresponding pin 29; and each signal carrying socket 35 is also connected by an appropriate conductor on the microstrip 39 to a corresponding pin 31. Each ground reference socket 37 is connected to a ground plane on the microstrip 37, which ground plane is also connected to a blunt-end pin (not shown) which is in line with the signal carrying pins 29 and is located at either end of the row. Locating pins 25 are also provided as in the "wire-over-ground" approach discussed above.

Figure 6:
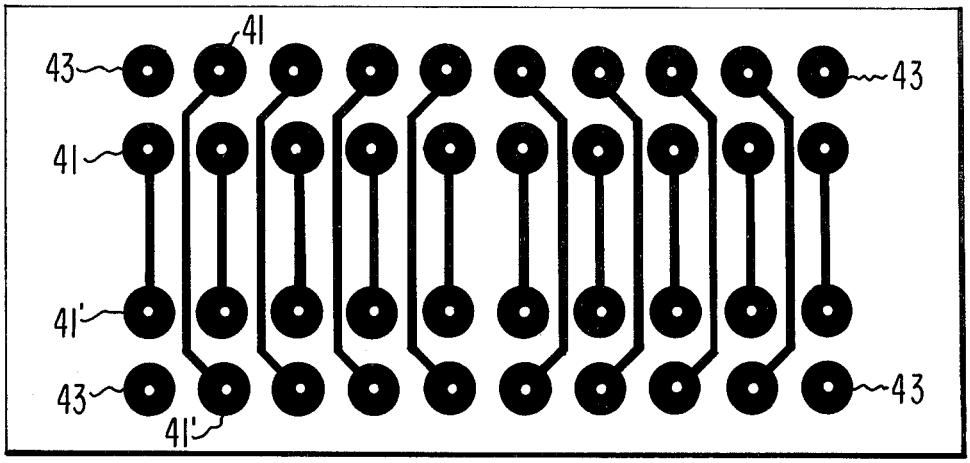
FIG. 6 is a diagram of a conductive circuit pattern which may be etched on the signal side of a flexible substrate for use with the microstrip connector of the present invention.
Figure 7:
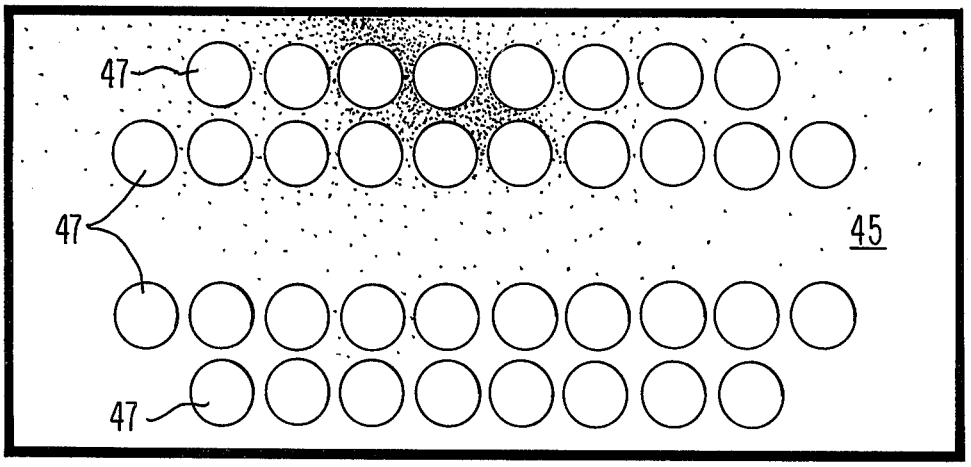
FIG. 7 is a diagram of a conductive surface pattern which may be etched as a ground surface on the ground side of a flexible substrate having a conductor pattern on the signal side as shown in FIG. 6.

The thin flexible microstrip 39 will now be further described with reference to FIGS. 6 and 7 which show signal level and ground plane level conductor patterns, respectively. FIG. 6 shows the signal carrying conductors of the microstrip 39 which are represented by the dark areas. The plurality of conducting pads 41 are interconnected to corresponding conducting pads 41'. The conducting pads 43 at each of the four corners of the pattern are not connected to anything else because the grounding sockets and blunt ended ground pins pass through these pads to make contact with the metallic conducting surface 45 which forms the ground plane as shown in FIG. 7. The signal carrying sockets 33, 35, and pins 31, 29, are conductively connected to the appropriate conducting pads 41, 41'.

FIG. 7 shows the etching pattern of the ground reference level surface of the microstrip 39 wherein the dark portions represent areas of the metallic-coated substate which have been etched away. That is, the circular dark areas 47 are areas on the substrate which have no metalization. These areas allow the conducting sockets 33, 35 and the conducting pins 31, 29 to pass through this portion of the microstrip 39 without touching any of the metal coated surface 45 which is the ground plane. It is important to note that the areas on the ground plane shown in FIG. 7 which correspond to the ground pin and ground socket pads 43 shown on the signal level surface illustrated in FIG. 6 are coated with copper. This allows connection of the ground sockets and pins to the ground plane surface of the microstrip 37.

From the above it is evident that the signal carrying spring sockets 33, 35 and PC board connecting pins 29, 31 are connected to the conducting pads 41 and 41' on the signal level surface of the microstrip 39 and pass through non-metalized portions on the ground plane surface of the microstrip 39. It is further evident that the ground pins and sockets do not transmit any signal on the signal level surface of the microstrip 39 but are connected to the entire metallic surface 45 of the ground level surface of the microstrip 39. Thus, a common ground surface is provided for all of the signal carrying interconnections between the signal level pads 41 and 41'.

The characteristic impedance of the microstrip transmission line printed circuit board connector as shown in FIGS. 4 through 7 is also given by the above Equation (1). However, an equivalent wire diameter must first be calculated for use in Equation (1). The equivalent wire diameter is quite accurately approximated by the following:

$$d_{equiv.} = 0.67w\,(0.8 + t/w) \qquad (6)$$

Where:

$d_{equiv.}$ is the equivalent wire diameter;

$w$ is the width of the signal carrying conductor interconnecting corresponding signal pads 39 and 39';

$t$ is the thickness of the etched signal carrying conductors.

Again to illustrate the use of the invention in a microstrip transmission line embodiment, an example calculation will be provided for a connector which is to be used to match a 50 ohm system. The material for the microstrip element will be an epoxy laminate to be embedded in an epoxy casting resin having a dielectric constant of 3.6. The width of the etch line will be 0.010 inches and the thickness of the etch conductor is 0.0028 inches. For the given parameters, application of Equation (6) results in a equivalent wire diameter of 0.0072 inches. Solving Equation (1) and using this equivalent diameter, the laminate substrate thickness necessary to achieve a 50 ohm impedance characteristic may be calculated. The result is that the thickness for the above given fixed parameters is 0.0078 inches. From this it can be seen that varying the substrate thickness, the conductor width and thickness, and the dielectric medium will result in the desired impedance.

With this detailed description of the structure and operation of the present invention it will be obvious to those skilled in the art that various modifications can be made without departing from the spirit and scope of the invention which is limited only by the following claims.

What is claimed is:

1. A multiple signal connector comprising:

a rectangular strip of conductive foil folded along its longitudinal axis to form a right angle and having a first conducting surface and a second conducting surface for providing a fixed reference potential over its conducting surfaces;

a plurality of conductors of predetermined configuration for carrying signals of varying potentials with respect to the fixed reference potential established by said conductive foil, said plurality of signal carrying conductors arranged in two rows with said conductive foil separating said first row from said second row, said first row of conductors associated with said first conducting surface and said second row of conductors associated with said second conducting surface, each of said conductors being dielectrically separated from said associated conducting surfaces by a predetermined distance which is constant for a substantial portion of the path of each conductor;

means for connecting said conducting surfaces and said conductors to apparatus external of the multiple signal connector; and a dielectric medium surrounding said conductive foil and said signal carrying conductors for cooperating with the configuration of said conductors and the predetermined distance between said conductors and said associated conducting surfaces whereby a characteristic impedance of the multiple signal connector is established by the distances separating said plurality of conductors from said associated conducting surfaces of the reference potential establishing conductive foil.

2. The multiple signal connector of claim 1 wherein said conductive foil is metallic and further includes metallic tabs at each of its four corners, said tabs being folded away from the region within the right angle formed by the rectangular strip.

3. The multiple signal connector of claim 2 wherein each of said conductors comprises a right-angle wire having its linear portions parallel to the corresponding linear portions of said metallic foil and being dielectrically separated from the surfaces of said metallic foil.

4. The multiple signal connector of claim 3 wherein said right-angle wires are arranged in two rows on either side of said metallic foil.

5. The multiple signal connector of claim 4 wherein said dielectric medium comprises a rigid dielectric body for maintaining the relative positioning of said conductive foil and right-angle wires.

6. The multiple signal connector of claim 5 wherein said external connecting means comprises portions of said signal carrying right-angle wires which extend beyond said rigid dielectric body at each end of said right-angle wires and which further comprises right-angle wires at either end of said metallic foil which conductively pass through said metallic tabs and which extend beyond said rigid dielectric body.

7. The multiple signal connector of claim 1 wherein said conductive foil and said signal-carrying conductors are mounted on a common rectangular flexible dielectric substrate which is folded along its longitudinal axis to form a right angle.

8. The multiple signal connector of claim 7 wherein each of said signal-carrying conductors comprises a discrete metallic conductive path which extends from a planar surface to the contiguous adjacent planar surface and wherein said conductive foil comprises a metallic coating over the two contiguous surfaces which do not have signal carrying wires except over those areas which are opposite the ends of said signal-carrying conductive paths.

9. The multiple signal connector of claim 8 wherein said dielectric medium comprises a rigid dielectric body for maintaining said dielectric substrate in a folded position.

10. The multiple signal connector of claim 9 wherein said external connecting means comprises:

spring sockets connected to the ends of said conductive paths which are all on one planar surface and spring sockets connected to said reference potential metallic coating on the reference plane opposite the signal carrying plane having said spring sockets; and pins connected to the other ends of said conductive paths and pins connected to the reference potential metallic coating on the reference plane opposite the signal carrying plane having said pins.

11. A multiple signal connector comprising:

a thin flexible microstrip having a plurality of conductive elements deposited thereon;

a distributed conductive surface deposited on said microstrip and overlaying said conductive elements for providing a fixed reference potential, said distributed conductive surface having apertures etched therethrough for exposing said plurality of conductive elements;

a plurality of discrete signal carrying conductors of predetermined dimensions carrying a plurality of individual signals which vary in level with respect to said fixed reference potential, said plurality of signal carrying conductors having a predetermined geometrical relationship to said distributed conductive member, each of said signal carrying conductors having a portion thereof extending through respective apertures in said distributed conductive member in a dielectrically spaced relationship and conductively intersecting respective conductive elements:

means for connecting said distributed conductive member and said conductive elements to apparatus external to the multiple signal connector; and a dielectric medium surrounding said distributed conductive surface and said plurality of conductive elements for cooperation with the configuration of the signal carrying conductors and the predetermined geometrical relationship between the distributed conductive element and the signal carrying conductors to establish a desired characteristic impedance.

12. The multiple signal connector of claim 11 wherein said fixed reference means comprises a distributed conductive surface.

13. The multiple signal connector of claim 12 wherein said conducting means comprises discrete signal carrying conductor in a dielectrically spaced relationship with said distributed conductive surface.

* * * * *